US005464201A

United States Patent [19]

Deen et al.

[11] Patent Number: 5,464,201

[45] Date of Patent: Nov. 7, 1995

[54] METHOD OF AND APPARATUS FOR PROCESSING SETS OF COPIES CORRESPONDING TO A SET OF ORIGINALS

[75] Inventors: Pieter B. J. Deen, Eindhoven; Nicolaas G. H. Linssen, Grubbenvorst; Godefridus J. Mennen, Budel, all of Netherlands

[73] Assignee: OCE-Nederland, B.V., Venlo, Netherlands

[21] Appl. No.: 282,561

[22] Filed: Jul. 29, 1994

[30] Foreign Application Priority Data

Aug. 2, 1993 [NL] Netherlands ..... 9301345

[51] Int. Cl.[6] ..... B42B 5/00; G03G 21/00; B21J 15/28

[52] U.S. Cl. ..... 270/53; 355/324; 227/5

[58] Field of Search ..... 270/53; 355/324; 227/5

[56] References Cited

U.S. PATENT DOCUMENTS

| | | | |
|---|---|---|---|
| 4,421,264 | 12/1983 | Arter et al. | 355/324 X |
| 4,878,656 | 11/1989 | Honjo et al. | 270/53 |
| 4,965,629 | 10/1990 | Hiroi et al. | 355/324 X |
| 4,985,729 | 1/1991 | Sampath et al. | 355/324 X |
| 5,073,803 | 12/1991 | Kato et al. | 270/53 X |
| 5,078,376 | 1/1992 | Yamada et al. | 270/53 |
| 5,140,380 | 8/1992 | Nakamura et al. | 270/53 X |
| 5,187,534 | 2/1993 | Iwata et al. | 270/53 X |
| 5,230,457 | 7/1993 | Hiroi et al. | 355/324 X |
| 5,290,020 | 3/1994 | Matsui et al. | 270/53 |
| 5,354,042 | 10/1994 | Coombs | 270/53 |

FOREIGN PATENT DOCUMENTS

| | | | |
|---|---|---|---|
| 62-186279 | 8/1987 | Japan | 355/324 |
| 4118295 | 4/1992 | Japan . | |
| 5-107847 | 4/1993 | Japan | 355/324 |

OTHER PUBLICATIONS

Patent Abstract of Japan, 05–050781, Mar. 2, 1993.
Patent Abstract of Japan, 04–118295, Apr. 20, 1992.

*Primary Examiner*—John E. Ryznic
*Attorney, Agent, or Firm*—Birch, Stewart, Kolasch & Birch

[57] ABSTRACT

A method and apparatus for discharging sets of copies or parts of such sets in stapled or unstapled condition, wherein those sets of copies or parts of such sets which are made from one and the same set of originals and which are required to be stapled are stapled only if the measured thickness of the first collected set of copies or part of such set is thinner than a predetermined thickness measurement ($X_1$) and if the measured thickness of subsequent collected sets of copies or parts of such sets is thinner than a predetermined thickness measurement $X_v$ which is greater than the first thickness measurement $X_1$, whereas parts of sets of copies made from one and the same original set and required to be unstapled are discharged when the measured thickness of collected parts of the first collected set of copies is equal to a predetermined thickness measurement $Y_1$ and when the measured thickness of collected corresponding parts of subsequent sets of copies is thinner than a predetermined thickness measurement $Y_v$, which is greater than the first thickness measurement $Y_1$.

7 Claims, 8 Drawing Sheets

METHOD OF AND APPARATUS FOR PROCESSING SETS OF COPIES CORRESPONDING TO A SET OF ORIGINALS

BACKGROUND OF THE INVENTION

1. Field of the Invention

The invention relates to an apparatus and method for processing copy sheets, and more specifically, to a novel method and apparatus for processing sets of copy sheets corresponding to sets of originals.

2. Discussion of Related Art

A method and apparatus of this kind are known from U.S. Pat. No. 4,878,656, which describes an apparatus for stapling a stack of copy sheets, which operates in dependence on the measured thickness of the stack of copy sheets for stapling, in such manner that stacks which are too thick are not stapled. Since the measured thicknesses of different sets of copies made from one and the same set of originals may differ from one another, e.g. due to tolerance differences in respect of the thicknesses of the copy sheets and errors occurring during measurement, this known apparatus has the disadvantage that these sets of copies sometimes are stapled and sometimes are not stapled if the thickness of the stacks of copy sheets for stapling is in the region of the thickness below which stapling is carried out and above which it is not.

SUMMARY OF THE INVENTION

Therefore, it is an object of the present invention to provide a copy sheet processing system which will overcome the above-noted disadvantages.

It is a further object of the present invention to provide a process for processing sets of copies, each set corresponding to a set of originals.

A further object of the present invention is to provide an apparatus for processing sets of copies successively delivered to the processing apparatus from a set of originals.

The foregoing objects and others are accomplished in accordance with the present invention, generally speaking by providing a method of processing sets of copies each corresponding to a set of originals, wherein a number of copy sheets associated with a set of copies are successively stacked at a collection point and the resulting stack of copies can be processed in a first manner in accordance with a first criterion when the stack has a thickness less than a first predetermined thickness measurement and in a second manner when the stack has a thickness equal to or greater than the first predetermined thickness measurement.

The invention also relates to an apparatus for processing sets of copies successively delivered by a copying machine from a set of originals, comprising a measuring means for measuring the thickness of delivered sets of copies, and control means which sets a processing means to a first procedure in response to a thickness measured by the measuring means which is less than a predetermined first thickness measurement and which set the processing means to perform a second procedure in response to a thickness measured by the measuring means equal to or greater than the predetermined first thickness measurement.

The successively formed stacks of copies each corresponding to the same set of originals are processed in the first manner in accordance with a second supplementary criterion when the stack of copies first formed in succession is as thick as or thinner than a second predetermined thickness measurement, which second predetermined thickness measurement is less than the first predetermined thickness measurement. This purpose of the present invention is further achieved by an apparatus of the type referred to above in that the control means activates the measuring means after the delivery of each copy sheet and the control means sets the processing means to the first procedure for the successively formed stacks of copies each corresponding to the same set of originals when the stack of copies first formed in succession is as thick as or thinner than a second predetermined thickness measurement, which second predetermined thickness measurement is less than the first predetermined thickness measurement. The effect of this method and apparatus according to the invention is that the different sets of copies made from original sets are processed uniformly within given limits.

According to one embodiment of the present invention, the first manner or procedure comprises stapling the copies stacked at the collection point and then removing the stapled copies from the collection point and the second manner or procedure comprises removing the collected copies from the collecting point unstapled. Consequently, differences in the thickness of the collected copy sets which are smaller than the difference between the two predetermined thickness measurements do not affect the uniformity in the stapling of sets of copies of one and the same set of originals.

According to another embodiment of the present invention, the first manner or procedure comprises removing from a collection point stacks of copies formed there and the second manner or procedure comprises delivering an error signal, and the first manner or procedure is always carried out when the stack of copies first formed in succession corresponding to a set of originals reaches a thickness less than the second predetermined thickness measurement and when the stacks of copies successively formed thereafter count the same number of copies as the stack of copies first formed in succession.

BRIEF DESCRIPTION OF THE DRAWINGS

The invention will be explained in detail in the following description with reference to the drawings wherein.

DETAILED DISCUSSION OF THE INVENTION

Figure 1:
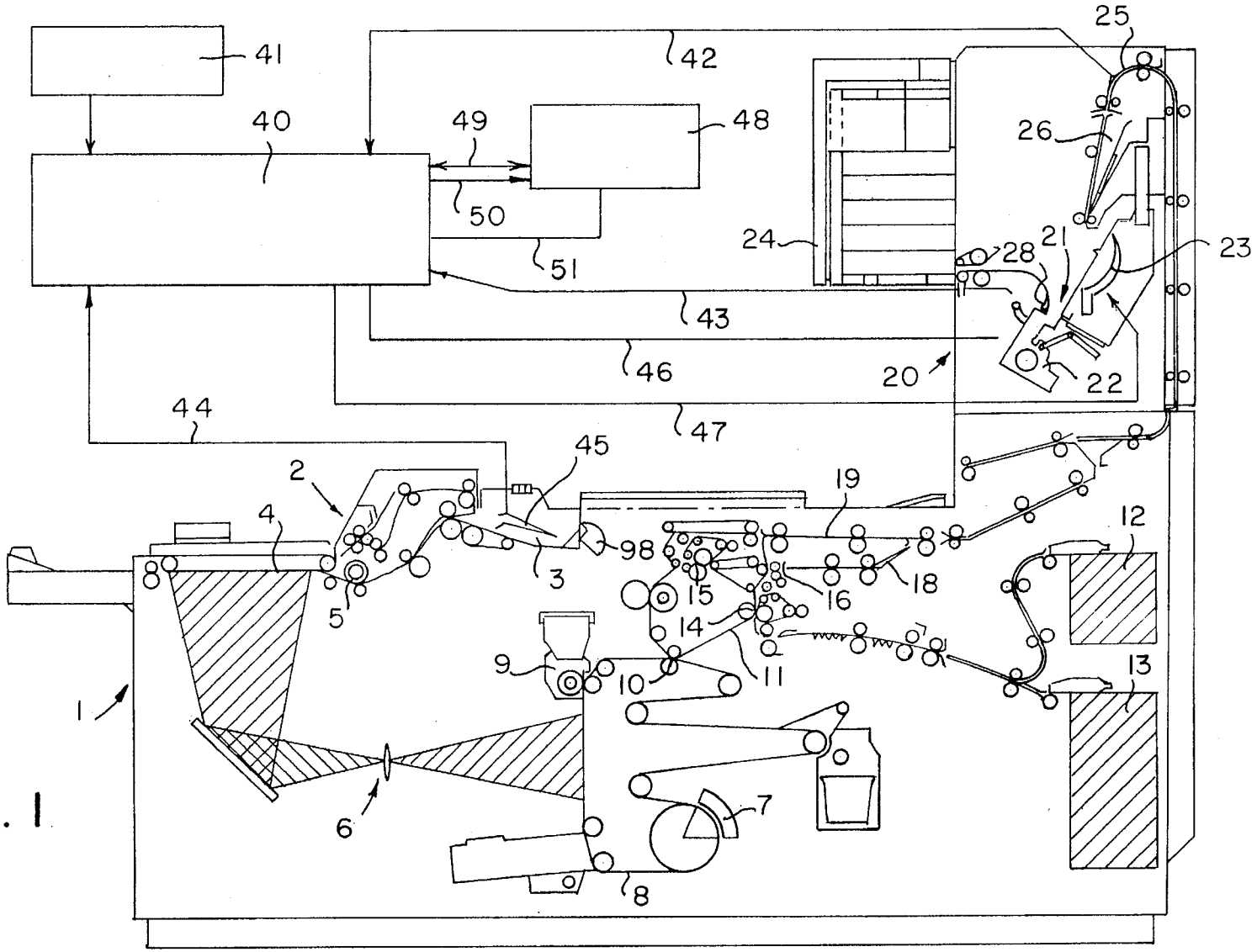
FIG. 1 is a cross-section of a copying machine to which the invention is applied.

The electrophotographic copying machine 1 shown in FIG. 1 comprises an original handling system 2 for recirculating one by one a set of originals placed in an inlet tray 3 to an exposure window 4 of the copying machine 1 and then back to the inlet tray 3. After being transported away from the window 4, originals printed on one side only are returned directly to the inlet tray 3 while originals printed on two sides are returned directly via a reversing loop 5 to the exposure window 4 after their first discharge therefrom, for exposure of the back of the original, and are then returned to the inlet tray 3, only after the second removal from the exposure window 4. An optical imaging system 6 projects images of each original on the exposure window 4 on to an endless photoconductive belt 8 uniformly charged by a charging device 7. Electrostatic images successively formed on the belt 8 are developed with developing powder by means of a developing device 9, whereupon these powder images are transferred to an endless image transfer belt 11 at an image transfer station 10. Powder images formed from the front of originals are transferred from the image transfer belt 11 in a first image transfer/fixing station 14 and fixed on receiving sheets fed from supply stacks 12 and 13. Powder images formed of the back of originals are transferred from the image transfer belt 11 in a second image transfer/ fixing station 15 and fixed on the other sides of the same receiving sheets. Receiving sheets coming from the first image transfer/fixing station 14 are fed for this purpose to image transfer/fixing station 15 via a reversing conveyor 16. Receiving sheets printed on only one side are fed via discharge conveyor 18 while receiving sheets printed on both sides are fed via discharge conveyor 19 to a copies processing device 20 for further processing.

The copies processing device 20 comprises a sloping collecting tray 21 in which copies made from a set of originals placed in the inlet tray 3 are stacked for stapling by the introduction of one or more staples in the bottom edge of the collected copies by means of a stapling device 22. A collected and possibly stapled set of copies is then fed to one of the receiving compartments 24 by means of ejector arms 23.

A likewise sloping buffer tray 26 is provided just above the collecting tray 21 in the copy feed path 25 leading to the collecting tray 21. This buffer tray 26 can operate as part of the feed path 25, but during the stapling of a set of copies in the collecting tray 21 it acts as a buffer to collect the first copies of the next set and feed them jointly to the collecting tray after clearing of the collecting tray 21.

Figure 2:
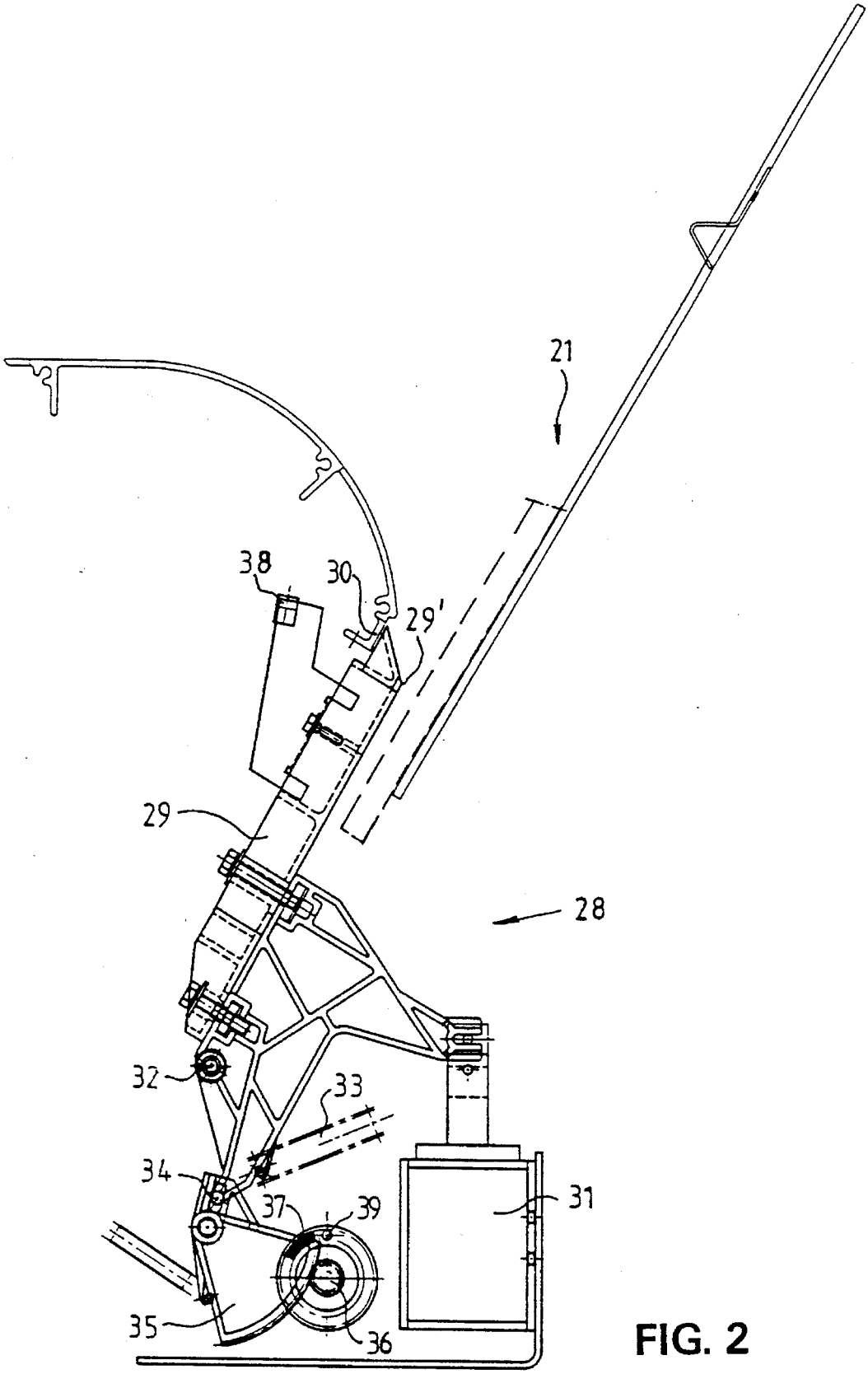
FIG. 2 shows a measuring device used in the copying machine shown in FIG. 1 for measuring the thickness of a stack of collected copies.

The collecting tray 21 is also provided with a measuring device 28 for measuring the thickness of a stack of copies collected in the collecting tray 21. The measuring device 28 shown in detail in FIG. 2 is integrated with a pressure application means for applying pressure to the edge zone of copies collected in the collecting tray 21, such edge zone being the zone where they are to be stapled. The pressure application means comprises a pressure application member 29 movable between a position of rest shown in FIG. 2 and a pressure application position in which the member 29 compresses the collected copies to form a straight stack and also to generate a measurement for the thickness of the resulting stack of copies. In the position of rest, the pressure application member 29 presses against an abutment 30 coated with a layer of resilient material. An electromagnet 31 moves the pressure application member 29, which is rotatable about axis 32, whenever a copy is deposited in the tray 21, from the position of rest to the pressure application position, in which an edge 29' of the pressure application member 29 presses on the stack of collected copies. When the electromagnet 31 is deenergized, a spring 33 pulls the pressure application member 29 back against the abutment 30, the resilient coating preventing the pressure application member 29 from rebounding from the abutment 30 when it reaches the position of rest. The rotary movement of the pressure application member 29 is converted, via a forked connection 34, to a rotary movement of a rotatable toothed segment 35 biased by a tension spring to eliminate the play in the transmission. Toothed segment 35 cooperates with the gearwheel 36 on which a pulse disc segment 37 is mounted. Each time a projection on the pressure application member 29 releases a detector 38 on its way into the pressure application position, the counting of pulses from the pulse disc segment 37 passing along pulse receiver 39 is initiated, the count stopping when the pressure application member 29 abuts the stack of copies in the collecting tray 21. The number of pulses counted is a measurement of the thickness of the stack, given a fixed distance between the bottom of the tray and the detector 38. The measuring device 28 is calibrated by means of a calibration block having a thickness of a nominal stack of copies to be processed, e.g. a thickness of 5.15 mm, equivalent to a stack of 50 copy sheets of a weight of 80 g/m$^2$ each of a thickness of 0.103 mm. The resolution of the pulse disc 37 of the measuring device 28 is one pulse per 0.1 mm shift. The pulse count value Z, representative of the stack thickness and obtained with the calibration block placed in the collecting tray 21, is used as a calibration value to check the stack thickness as will be explained hereinafter.

A control system 40 for the copying machine 1 comprises an adjustment system 41 for adjusting the number of copies, respectively n1, n2, n3, etc, which are to be successively collected in the collecting tray 21 and possibly stapled. These numbers n1, n2, n3, etc correspond to numbers of original forming subsets of originals placed in tray 3. The fact that these numbers of copies have been reached is detected by counting signals 42 fed to the control system 40 and derived from the passage of copies in the feed path 25. This count value is reset to zero after each collection of a required number of copies n. A measuring signal 43 is continuously fed to the control system 40 and represents the thickness of the copies collected in the collecting tray 21, as measured by the measuring device 28. A detection signal 44 is also fed to the control system 40 whenever the last original of a stack of originals placed in inlet tray 3 leaves the latter tray. Signal 44 is generated by a set divider 45 known per se at the inlet tray 3.

Control system 40 delivers a stapling signal 46 whenever a number of copies n1, n2, n3, etc for stapling is in the collecting tray 21, in response to which the copies processing device 20 staples the collected copies and then delivers them to the receiving tray 24. Control system 40 delivers an ejection signal 47 whenever the copying machine 1 is not set to stapling and the collecting capacity of the collecting tray 21 or the end of the set of copies is reached, in response to which the ejector arms 23 discharge the collected set of copies unstapled to receiving tray 24. The control system 40 also comprises a memory 48 in which it is possible to store a count value derived from counting signal 42 by means of a signal 49 in order to record count values which can be reduced by a signal 50 delivered by the control system 40 and can be reset to zero by a reset signal 51, as will be explained hereinafter by reference to a description of the flow diagrams shown in FIGS. 3 and 4.

Of course a stapling device cannot staple a package comprising an unlimited number of sheets. Similarly, a tray for collecting a number of sheets cannot be used for a stack of sheets of unlimited size. The automatic processing device 20 used in the copying machine 1 should therefore be protected against stapling excessively thick sets of copies and collecting an excessive number of sheets. The maximum permissible stapling capacity is usually lower than the maximum permissible collecting capacity. A conventional stapling limit is 50 sheets of a weight of 80 g/m$^2$ and a conventional collecting limit may be 100 sheets.

On the basis of a sheet thickness of 0.103 mm ±6% of sheets of a weight of 80 g/m$^2$, 50 sheets result in a thickness of 5.15 mm±6%. To guarantee that 50 sheets of a weight of 80 g/m$^2$ can be stapled under all conditions the stapling limit for the first set is set at the calibration value Z plus the number of pulses corresponding to the measuring accuracy, the difference between the maximum tolerance on measuring and the minimum tolerance on calibration (=total 0.4 mm or 4 pulses), and the maximum tolerance of 6% on the sheet thickness (on 5.15 mm=0.3 mm or 3 pulses), and 50×2 times a toner layer thickness of 0.002 mm in the case of sheets printed on both sides (=0.2 mm or 2 pulses). The stapling limit for the first set of copies or part of the set is thus fixed at $X_1$=Z+9 pulses (=6.05 mm). If, during the production of a number of sets of copies from one set of originals, the measuring device 28 measures a thickness just below 6.05 mm in the case of the first collected set of copies or part of the set, with all the tolerances at a minimum value, and if it is required to ensure that a corresponding subsequent set of copies or part of such set in which all the tolerances are at a maximum value can be stapled to achieve stability in the processing of identical sets of copies or identical parts thereof, then the stapling limit for the processing of subsequent sets of copies must be at a value of 6.05 mm + the maximum measurement difference tolerance of 2×0.2 mm (=0.4 mm or 4 pulses)+ the maximum sheet thickness tolerance difference of 2×6% of 5.15 mm (=0.618 mm or 7 pulses), thus about 7.1 mm in total. The stapling limit $X_v$ for subsequent sets of copies or parts of such sets is therefore fixed by the formula $X_v$=$_1$+11 pulses or $X_v$=Z+20 pulses (7.15 mm).

In the collecting tray 21, 20, 30, 40 or 50 more sheets can be collected than the 50 sheets that can be nominally stapled therein. In comparison with the stapling limit $X_1$, the collecting limit Y, at which the collected copies of a first set should be discharged from the collecting tray 21 is fixed at 6.05 mm+A×0.1+6% of A×0.103 (maximum sheet thickness tolerance)+2×0.002A (maximum toner layer thickness)= 6.05+0.11A, where A is the number of extra sheets that can be collected, hence 20, 30, 40 or 50. Given A=20, $Y_1$ =$X_1$+20×1.1=Z+9+22=Z+31 pulses (=8.25 mm).

On analogy with the above discussion of the stapling limit for the first and subsequent sets of copies, the following is taken as a criterion, for unstapled collection of subsequent sets of copies, for discharging subsequent sets of copies: $Y_v$=$Y_1$+A×0.1+12% of A×1.03 (maximum sheet thickness tolerance). Given A=20, $Y_v$=$X_v$+20×1.12=Z+20+23=Z+43 pulses (=9.45 mm).

The values of $X_v$, and $Y_v$ determined for this purpose are minimum values which must be taken into account for subsequent sets of copies or parts of such sets in order to achieve a consistent stapling and/or ejection of sets of copies under normal conditions for a given copying job.

Figure 3A:
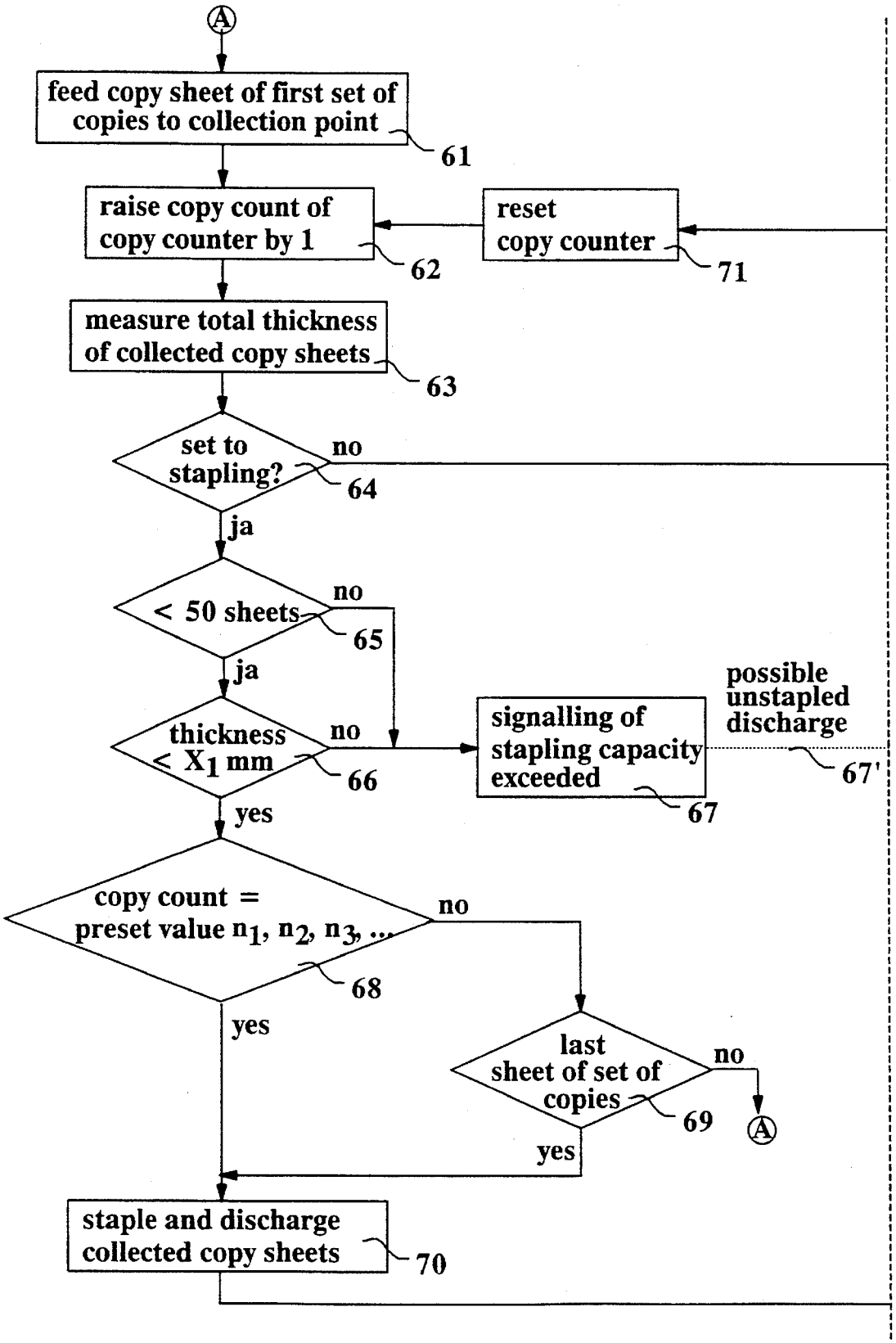
FIGS. 3A and 3B are flow diagrams of the processing of copy sheets forming part of the first set of copies of a set of originals.
Figure 3B:
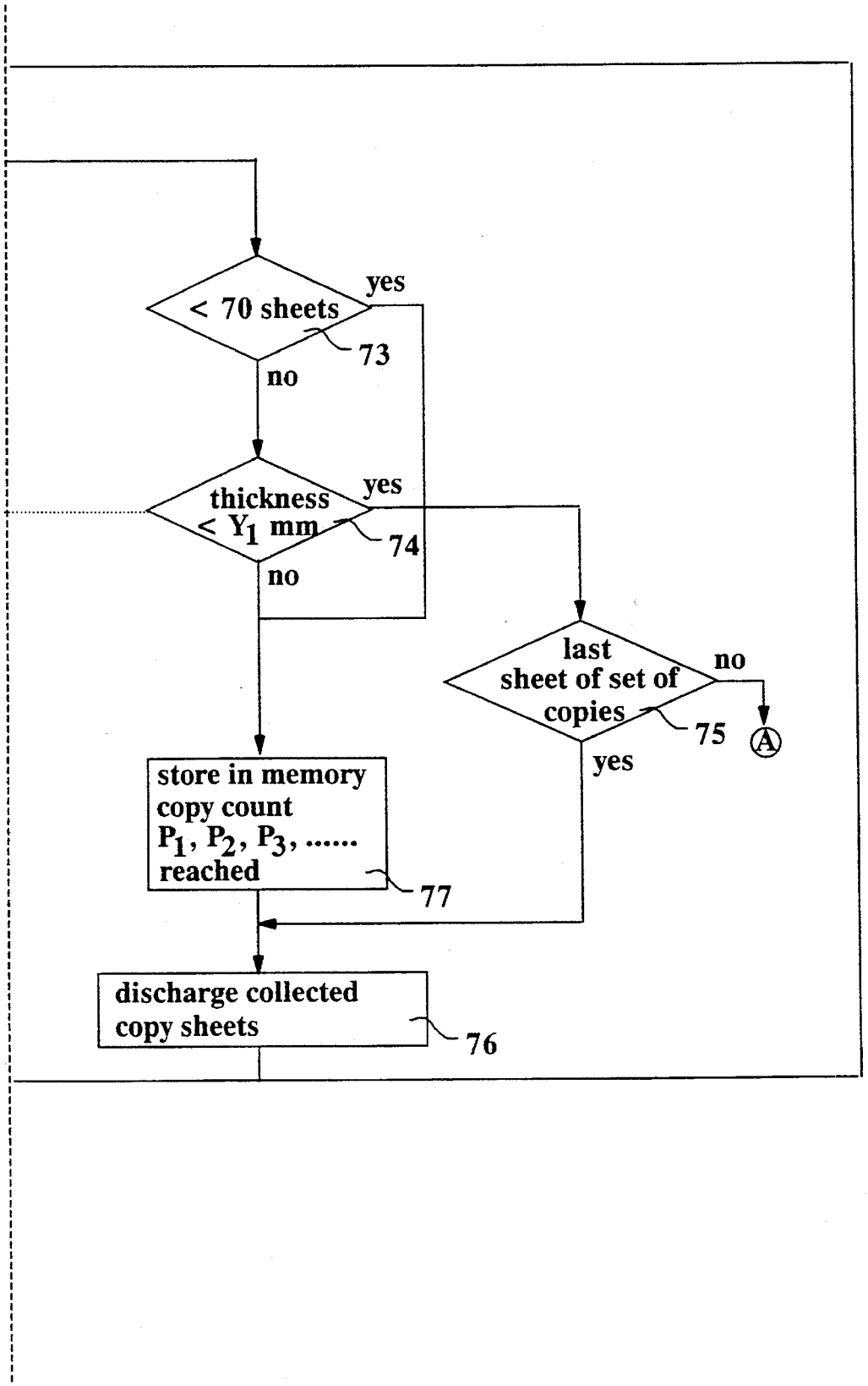

The operation of the copying machine 1 shown in FIG. 1 in respect of the control of the method of treating copies collected successively in the collecting tray 21 will now be explained by reference to the flow diagrams shown in FIGS. 3A/3B and 4A/4B. A control cycle A starts with the delivery to the collecting tray 21 of a copy sheet of a first set of copies from a set of originals placed in inlet tray 3, as shown in block 61 in the flow diagram illustrated in FIG. 3A. Delivery of a copy is detected in feed path 25 of the copies processing device 20, whereupon an associated signal 42 is fed to the control system 40 to increase the count of a copy counter as shown in block 62. After delivery of a copy to collecting tray 21, the measuring device 28 shown in detail in FIG. 2 is activated in block 63 to measure the thickness of the sheets collected up until then. Depending on the adjustment of the copying machine to discharge collected copies either in the stapled or unstapled condition in accordance with block 64, either the left-hand part or the right-hand part of the flow diagram is then followed. If the machine is set to stapling, blocks 65 and 66 successively determine whether the collected copies exceed a predetermined number of sheets, e.g. 50, or a predetermined thickness measurement $X_1$. Checking the number of sheets in accordance with block 65 offers the user a specific degree of clarity and predictability as to the number of sheets that can be stapled, but it can also be omitted in the light of the present invention. If it is found that at least one of these measurements (number and thickness $X_1$) has been exceeded, block 67 delivers a signal to the control panel of the copying machine 1 to show that the stapling capacity is exceeded and the copying machine accordingly stops copying, or continues copying and the associated copies are then delivered to one of the receiving trays 24 in the unstapled condition. If the number and thickness of the collected copies remain below the predetermined measures, then in block 68 the copy count reached is compared with the numbers of copies n1, n2, n3, etc to which the control panel may have been set, at which numbers the stapling device 22 must be activated to staple the subsets of the set of copies. If no numbers of copies have been set or if the numbers of copies that have been set have already been passed, then the copies still present in the collecting tray 21 are stapled and discharged to receiving tray 24, as shown in block 70, on receipt of a last sheet detection signal 44 in accordance with block 69, and the copies counter is reset to zero (block 71).

If the machine is not set to stapling, blocks 73 and 74 successively detect whether the collected copies exceed a predetermined number of sheets, e.g. 70, 80, 90 or 100, or a predetermined thickness measurement $Y_1$, in which case checking the number of sheets can be omitted if required. If the number and thickness of collected copies remain below the predetermined measurements, and if there is a last sheet signal 44 in accordance with block 75, the collected copies are directly discharged to the receiving tray 24 in accordance with block 76. If, however, after a copy sheet has been fed to the collecting tray 24, one of the predetermined measurements (number 70, 80, 90 or 100, or thickness $Y_1$ respectively) is reached, the collected copies are also discharged, but the copy count that the copy counter has then reached is stored in memory 48, as shown in block 77. In this way a first set of copies from a set of originals is deposited in parts if such set exceeds the capacity of collecting tray 21, the size of the parts being determined in a memory. The control cycle A is carried out each time a copy is discharged from a first set of copies made from the set of originals.

Figure 4A:
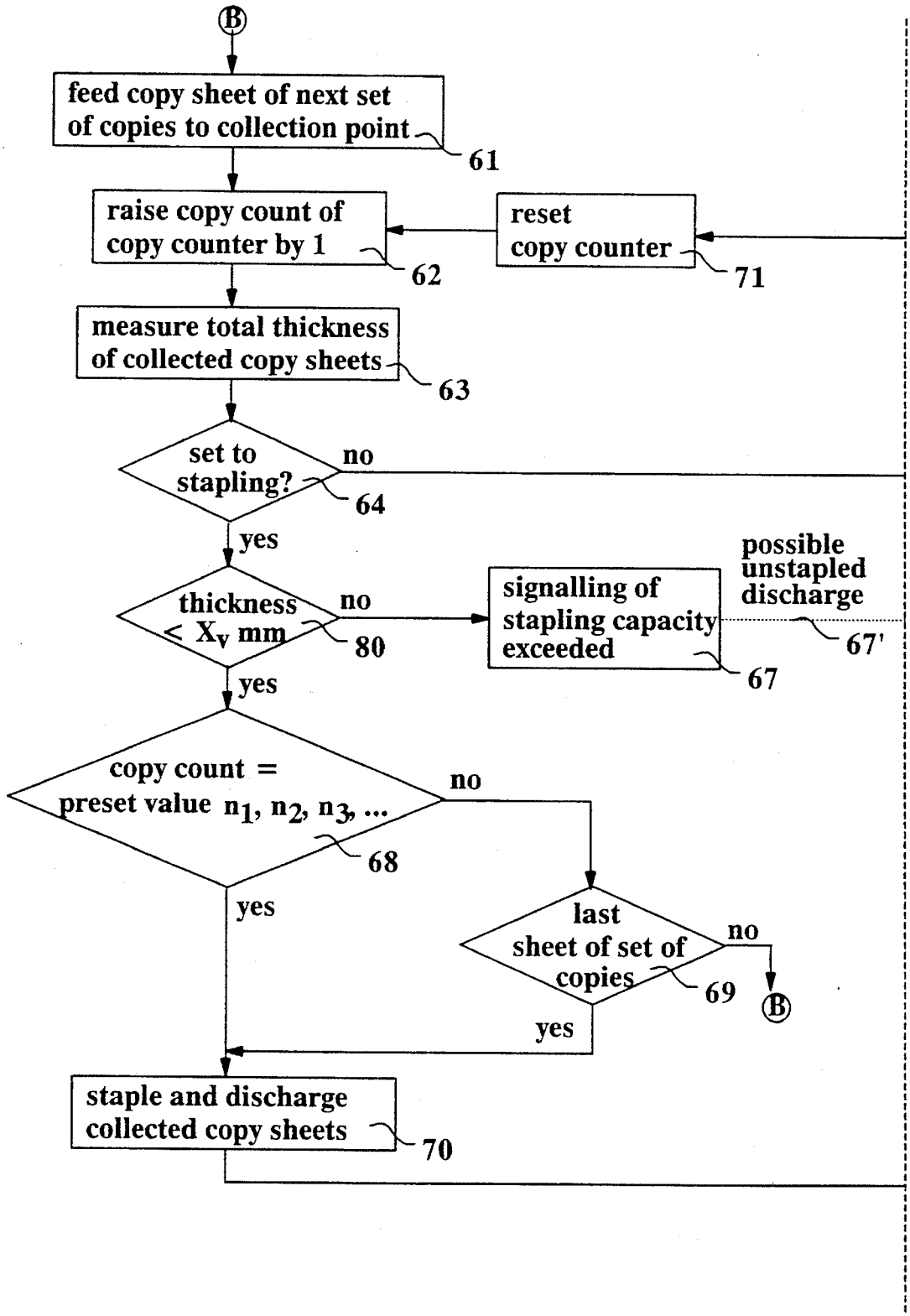
FIGS. 4A and 4B are flow diagrams of the processing of copy sheets forming part of subsequent sets of copies of a set of originals.
Figure 4B:
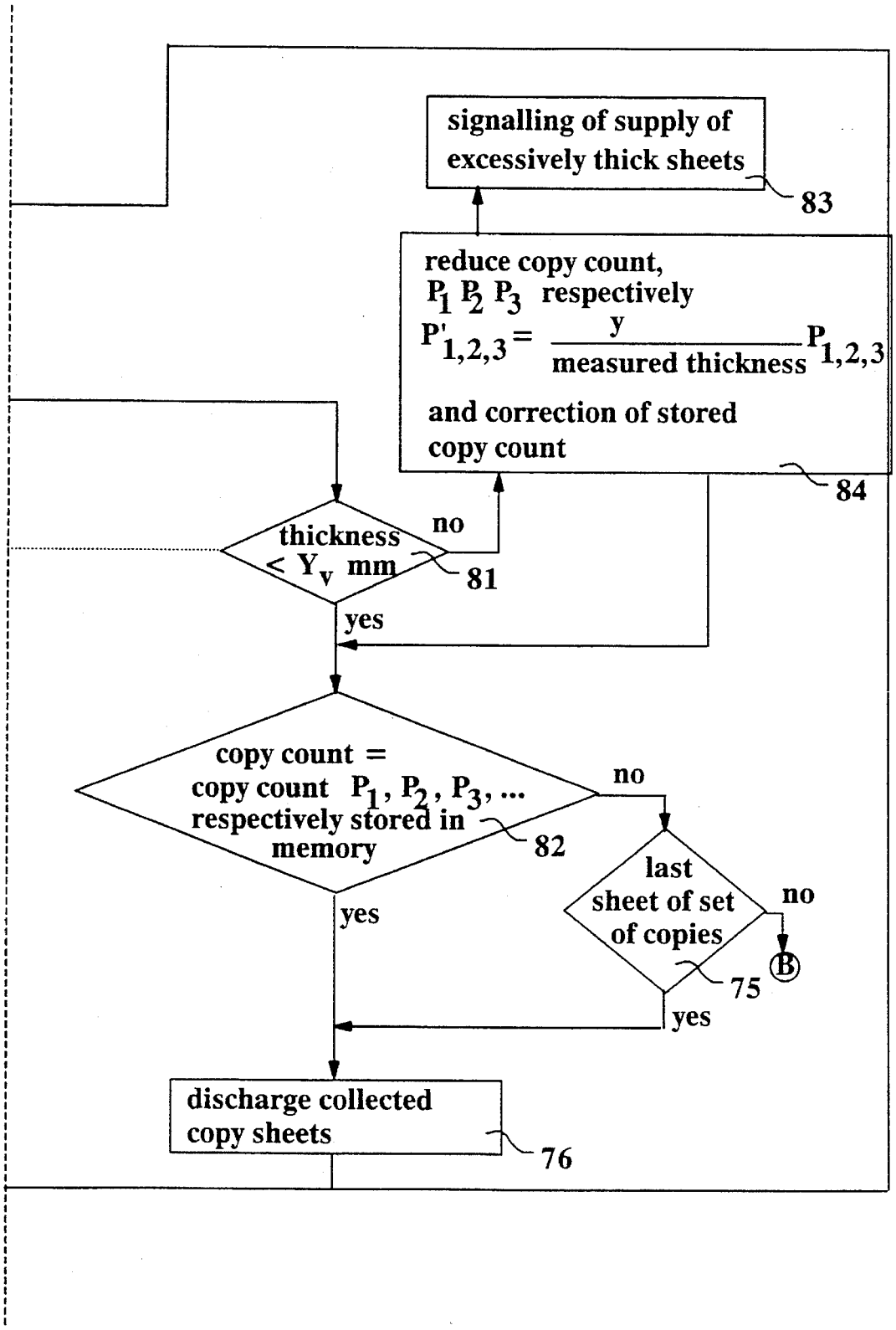

On the discharge of a copy from subsequent sets of copies made from the set of originals, the control cycle B shown in FIGS. 4A and 4B is followed. In FIGS. 4A and 4B, blocks corresponding to blocks of the flow diagram shown in FIGS. 3A and 3B have been denoted by the same reference numerals. To check the thickness of a stapled or unstapled set of copies or part of such set, blocks 80 and 81 respectively use a larger thickness measurement, $X_v$ and $Y_v$ respectively, than in the case of the first set of copies made from a set of originals, for the reasons explained hereinbefore. If the machine is set to stapling and if it is found that the thickness measurement $X_v$ has been exceeded, block 67 signals to the control panel of the copying machine that receiving sheets fed from inlet tray 12 and/or 13 are too thick. If the thickness measured keeps below the thickness measurement $X_v$ the stapling device 22 is activated and the stapled set of copies or the part thereof to which the machine has been set is deposited in receiving tray 24.

If the machine is set to non-stapling and the thickness measured keeps below the thickness measurement $Y_v$, then when the copy counts stored in memory 40 are reached in accordance with block 77 (block 82), and when the last copy has been reached in accordance with signal 44, the collected copies are fed from the collecting tray 21 to the receiving tray 24. If the measured thickness is found to exceed the thickness measurement $Y_v$, then in block 83, as in the case of $X_v$ being exceeded in block 67, the supply of excessively thick receiving sheets is signalled. Optionally, in accordance with block 84, the copy count or counts stored in memory 40 can then be reduced in accordance with the ratio between the associated predetermined thickness measurement $Y_1$ and the measured thickness of the subset.

Figure 5:
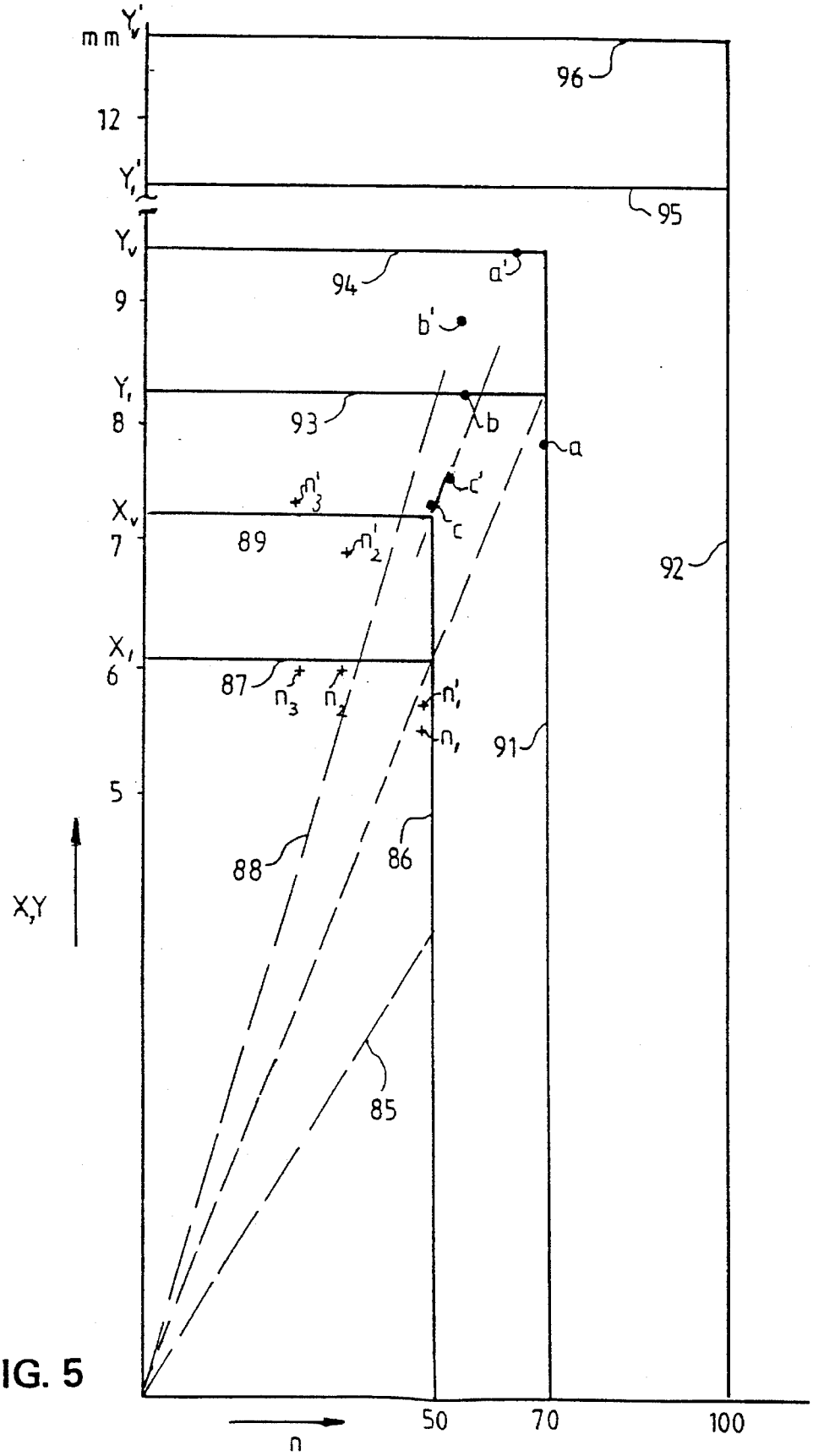
FIG. 5 is a graphic representation of the operation of a method and apparatus according to the instant invention.

FIG. 5 graphically illustrates the relationship between the number of copies (n) in a set of copies or part of such set and the thickness (X, Y) of the concerned set of copies of parts of such set. As already explained, a set of 50 copies of a weight of 80 g/m$^2$ has a nominal thickness of 5.15 mm. A stack of copies thinner than 80 g/m$^2$ reaches a boundary line 86 along line 85 before reaching a boundary line 87 representing a thickness of 5.15 mm. For a stack of this kind, a stapling limit of 50 sheets (line 86) is decisive. A stack of copies thicker than 80 g/m$^2$ reaches boundary line 87 before boundary line 86 as shown by line 88. For these sets of copies or parts of such sets the stapling limit 87 for the first copy set is at the thickness measurement $X_1$=6.05 mm and for the subsequent sets of copies the stapling limit 89 is found at a thickness $X_v$=7.15 mm. A corresponding relationship applies to the limit for discharging copies in the unstapled condition.

FIG. 5 shows an example relating to the stapling of (sub) sets of copies respectively comprising 49(n1), 35(n2) and 25(n3) copy sheets. In the case of the first set of copies made from a set of 49+35+25=109 originals, the stapling limit of 50 sheets is just not reached for the first subset n1 (nor is the stapling limit X1) while in the case of subsets n2 and n3 printed on thicker receiving material the stapling limit $X_1$ has just not been reached. The three subsets are therefore stapled. In the case of the second set of copies made from the same set of originals, the stapling limit of 50 sheets is just not exceeded for the first subset n1', and the same applies to the thickness stapling limit. In the case of the second subset n2', the thickness stapling limit $X_1$ is exceeded but the thickness stapling limit $X_v$ is not exceeded while for the third subset n3', both the stapling limit $X_1$ and the stapling limit $X_v$ are exceeded. Thus the first subsets are stapled and the third subset is not stapled and a relevant warning is given.

As stated previously, the collecting capacity of a collecting tray can usually be set to a larger number of sheets than the stapling capacity of a stapling device, e.g. at a minimum of 70 sheets of 80 g/m$^2$. If conditions are favorable, an even greater collecting capacity can be permitted without jeopardizing reliable operation. Such conditions may lie in the nature of the copy sheets to be collected, the type of printing, e.g. single-sided or double-sided, climatological conditions such as the moisture content of the sheets and specific machine tolerances. Depending on these, the collecting limit can be adjusted by the user to 70 sheets (line 91) and 100 sheets (line 92). The associated values for $Y_1$ and $Y_v$ for the maximum thicknesses of numbers of copy sheets to be collected are indicated in FIG. 5 for stacks of 70 sheets by lines 93 and 94 and for stacks of 100 sheets by lines 95 and 96.

FIG. 5 also shows by a, b and c, respectively, for a set of copies of 180 sheets, 70 sheets, 60 sheets and 50 sheets an example of collecting limits which have been obtained for the first set of copies using, for example, a collection limit of 70 sheets. Point a represents a first subset with relatively thinner sheets and point b a second subset with relatively thicker sheets in comparison with the third subset c. The second subset therefore has a thickness measurement $Y_1$ as the collection limit. Of the next set of copies, the first subset is, for example, so much thicker that after 68 sheets instead of 70 sheets the thickness measurement $Y_v$ which now applies as a collection limit instead of $Y_1$ is reached, as indicated by point a'. If the next subset of 60 sheets then has a thickness between $Y_1$ and $Y_v$ as shown by b', the collection limit for the second subset remains at 60 sheets. The third subset comprises the remaining number of sheets, namely 180–68 –60=52 sheets, provided that the value $Y_v$ is not exceeded when this number is reached, as denoted by point c'. If the collection limit $Y_v$ is not exceeded when the next sets of copies are made, then discharge limits to 68, 60 and 52 sheets determined in the case of the second set of copies are maintained for the discharge of the subsets of each following set of copies. If a change of subset limits as indicated for the first and second set of copies is not required, then after a set of copies has been deposited with different discharge limits the copying process is discontinued and a warning is given that the receiving sheets are too thick, i.e. the receiving sheets have thicknesses outside the tolerance limits, so that the previously determined discharge limits are maintained.

Figure 6:
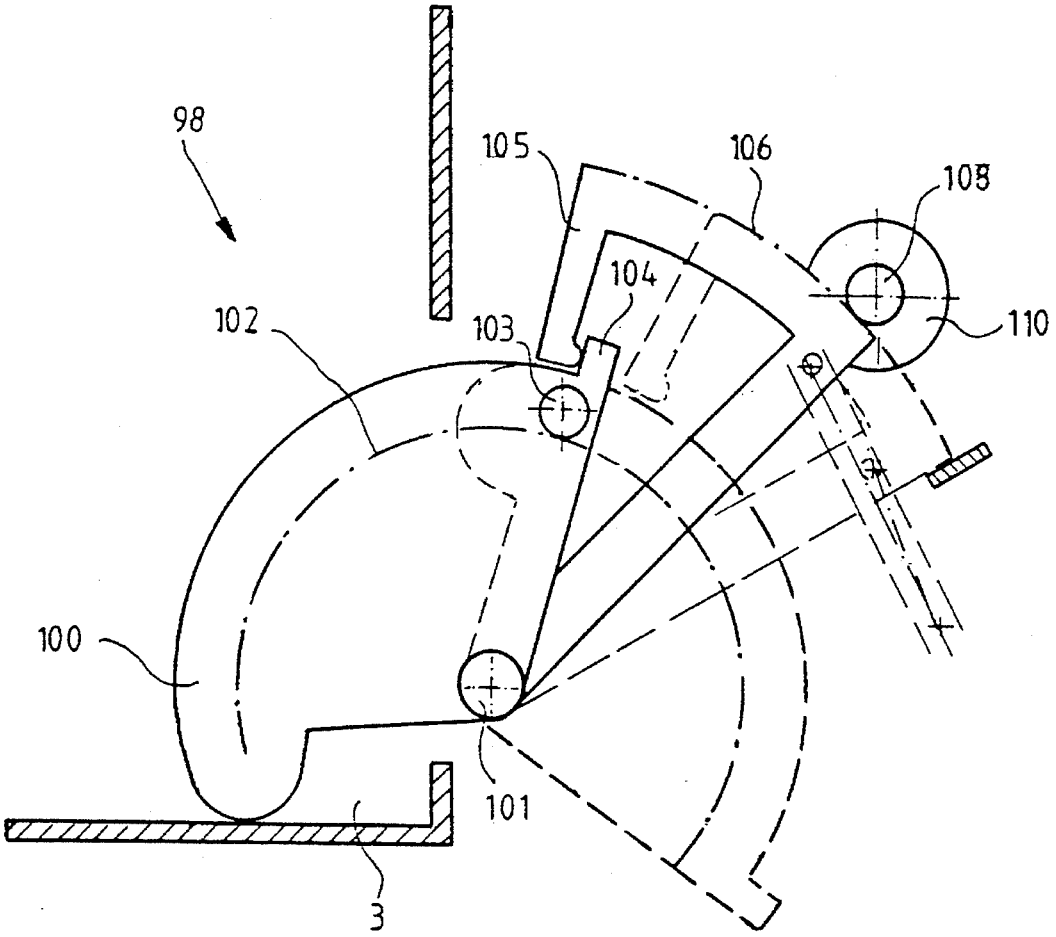
FIG. 6 shows a measuring device used in the copying machine shown in FIG. 1 for measuring the thickness of a stack of originals.

The measuring device 36 shown in FIG. 1 for measuring the thickness of a stack of originals placed in inlet tray 3 is shown in detail in FIG. 6. Measuring device 98 comprises a finger 100 pivotable about an axis 101 situated on that side of the inlet tray 3 which is remote from the exposure window 4 and which extends in a direction across the feed and return direction of the originals.

Finger 100 is pivotable between a with a broken line indicating an inoperative position in which the finger is situated completely outside the inlet tray 3 so that the tray is free to receive originals or remove originals therefrom, and a with a solid line indicating an operative position in which the finger 100 presses on the stack of originals in the tray to determine its thickness. To turn the finger 100 the latter is provided with a gear rim 102 cooperating with a pinion 103 disposed at a fixed point and drivable in two directions by means of a motor. Finger 100 is also provided with a hook-shaped cam 104 cooperating with an arm 105 also pivotable about axis 101. Arm 105 is provided with a gear rim 106 cooperating with a pinion 108 connected to potentiometer 110. On rotation of the finger 100 from the inoperative position to the operative position, cam 104 engages arm 105 when finger 100 is in a position just above an inserted stack of originals of maximum permissible thickness, e.g. a thickness associated with 100 sheets. On further rotation of the finger 100 in the direction of the stack of originals cam 104 drives arm 105 until the finger 100 engages the stack. The range of measurement of potentiometer 110 is equivalent to the range in which the thickness of the stack can vary and thus provides an accurate measurement of the thickness of the stack of originals, e.g. with a resolution in the range of from 0 to 10 inserted originals ±2 sheets and thereabove slightly more. The measuring device 98 is calibrated by measuring the resistance of the potentiometer 110 with the inlet tray 3 empty to give a measurement for zero inserted originals.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of processing sets of copies each corresponding to a set of originals, which comprises stacking a number of copy sheets associated with a set of copies successively at a collection point, processing said stack of copies in a first manner in accordance with a first criterion when said stack has a thickness less than a first predetermined thickness measurement ($X_v$, $Y_v$) and processing said stack of copies in a second manner when said stack has a thickness equal to or greater than said first predetermined thickness measurement ($X_v$, $Y_v$), characterized in that the successively formed stacks of copies, each stack corresponding to the same set of originals, are processed in a first manner in accordance with a second supplementary criterion when said stack of copies first formed in succession is as thick as or thinner than a second predetermined thickness measurement ($X_1$, $Y_1$), which second thickness measurement ($X_1$. $Y_1$) is less than the first thickness measurement ($X_v$, $Y_v$).

2. A method according to claim 1, characterized in that said first manner further comprises stapling said copies stacked at said collection point and then removing said stapled copies from said collection point and said second manner comprises removing said collected copies from said collecting point, unstapled.

3. A method according to claim 1, characterized in that said first manner comprises removing from said collection point stacks of copies formed there and said second procedure comprises delivering an error signal and in that the first manner is always carried out when the stack of copies first formed in succession of forming stacks of copies corresponding to a set of originals reaches a thickness less than said second predetermined thickness measurement ($Y_1$) and when said stacks of copies successively formed thereafter count the same number of copies as the stack of copies first formed in succession.

4. Apparatus including a processing means for processing sets of copies from a set of originals successively delivered by a copying machine, comprising a measuring means for measuring the thickness of delivered sets of copies, and control means which sets said processing means to a first procedure in response to a thickness measurement provided by said measuring means which is less than a predetermined first thickness measurement ($X_v$, $Y_v$) and which sets said processing means to a second procedure in response to a thickness measurement provided by said measuring means which is equal to or greater than said predetermined first thickness measurement, characterized in that said control means activates said measuring means after the delivery of each copy sheet and in that said control means sets said processing means to said first procedure for the successively formed stacks of copies each corresponding to the same set of originals when the stack of copies first formed in succession is as thick as or thinner than a second predetermined thickness measurement ($X_1$, $Y_1$), which second thickness measurement ($X_1$, $Y_1$) is less than the first thickness measurement ($X_v$, $Y_v$).

5. Apparatus according to claim 4, further including stapling means for stapling copy sheets delivered to a collection point, and discharge means for removing collected copy sheets from said collection point, characterized in that setting means are provided to set the apparatus such that the first procedure comprises successively activating the stapling means and the discharge means by the control means and the second procedure solely comprises activating the discharge means by the control means.

6. Apparatus according to claim 4 or 5, further including a discharge means for removing collected copies from a collection point, characterized in that counting means are provided to count copy sheets at the collection point, and the setting means are provided to so set the apparatus such that the first procedure comprises activating the discharge means by the control means and the second procedure comprises delivering an error signal by the control means and in that the control means activates the first procedure when, in the case of the first stack or stacks of copy sheets formed in succession and corresponding to a set of originals, the measuring means measures a thickness equal to or less than the second predetermined thickness measurement ($Y_1$) and when, in the case of a subsequently formed stack or stacks of copy sheets corresponding to the same set of originals, the counting means counts a number of copy sheets equivalent to the copy sheets processed according to the first procedure in the case of the first stack or stacks formed in succession.

7. Apparatus according to claim 6, further including memory means provided to store count values ($P_1$, $P_2$, $P_3$, etc) corresponding to the number or numbers of copy sheets counted by the counting means and collected at the collection point in the case of the first stack or stacks of copy sheets formed in succession and wherein said control means reduces the stored count values when the measuring means, in the case of the following stack or stacks of copy sheets formed in succession and corresponding to the same set of originals, measures a thickness greater than the first predetermined thickness measurement ($Y_v$) in such manner that each new count value ($P_1'$, $P_2'$, $P_3'$) is in the same ratio to the corresponding old count value ($P_1$, $P_2$, $P_3$) as the second predetermined thickness measurement ($Y_1$) is to the measured thickness measurement.

* * * * *